US011077491B2

(12) United States Patent
Meret et al.

(10) Patent No.: US 11,077,491 B2
(45) Date of Patent: Aug. 3, 2021

(54) CONTINUOUS CASTING APPARATUS AND CORRESPONDING METHOD

(71) Applicant: DANIELI & C. OFFICINE MECCANICHE SPA, Buttrio (IT)

(72) Inventors: Michele Meret, Rivignano Teor (IT); Gianni Del Forno, Colloredo di Prato (IT); Antonio Sgro', Reana del Rojale (IT); Michele Papinutto, Rive d'Arcano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 16/497,121

(22) PCT Filed: Mar. 29, 2018

(86) PCT No.: PCT/IT2018/050056
§ 371 (c)(1),
(2) Date: Sep. 24, 2019

(87) PCT Pub. No.: WO2018/179021
PCT Pub. Date: Oct. 4, 2018

(65) Prior Publication Data

US 2021/0121946 A1 Apr. 29, 2021

(30) Foreign Application Priority Data

Mar. 29, 2017 (IT) ..... 102017000034742

(51) Int. Cl.
*B22D 11/128* (2006.01)
*B21B 1/46* (2006.01)
*B22D 11/12* (2006.01)

(52) U.S. Cl.
CPC ..... *B22D 11/1282* (2013.01); *B21B 1/463* (2013.01); *B22D 11/1226* (2013.01); *B22D 11/1287* (2013.01)

(58) Field of Classification Search
CPC ..... B22D 11/1282; B22D 11/1226; B22D 11/1287; B21B 1/463
See application file for complete search history.

(56) References Cited

U.S. PATENT DOCUMENTS 3,645,323 A 2/1972 Vogt et al.

FOREIGN PATENT DOCUMENTS

JP 2013043217 A 3/2013
WO 2009144107 A1 12/2009

OTHER PUBLICATIONS

Int'l Search Report and Written Opinion dated Jun. 12, 2018 in Int'l Application No. PCT/IT2018/050056.

(Continued)

*Primary Examiner* — Kevin P Kerns
*Assistant Examiner* — Steven S Ha
(74) *Attorney, Agent, or Firm* — Panitch Schwarze Belisario & Nadel LLP

(57) ABSTRACT

Continuous casting apparatus comprising a plurality of compression units (11), each of which is defined by a lower roll (12) and an upper roll (13) configured to exert a compression action on a cast metal product (P). Each lower roll (12) defines with the respective upper roll (13) a passage gap (14) for the metal product (P). The passage gaps (14) of the compression units (11) are disposed aligned along a casting axis (Z) with an at least partly curved development. A straightening roll (15) is disposed on the extrados side of said casting axis (Z) and between at least two of the lower rolls (12).

10 Claims, 2 Drawing Sheets

(56) References Cited

OTHER PUBLICATIONS

Int'l Preliminary Report on Patentability dated Feb. 19, 2019 Int'l Application No. PCT/IT2018/050056.

CONTINUOUS CASTING APPARATUS AND CORRESPONDING METHOD

CROSS-REFERENCE TO RELATED APPLICATION

This application is a Section 371 of International Application No. PCT/IT2018/050056, filed Mar. 29, 2018, which was published in the English language on Oct. 4, 2018, under International Publication No. WO 2018/179021 A1, which claims priority under 35 U.S.C. § 119(b) to Italian Application No. 102017000034742, filed Mar. 29, 2017, the disclosures of which are incorporated herein by reference in their entirety.

FIELD OF THE INVENTION

The present invention concerns a continuous casting apparatus and the corresponding continuous casting method.

In particular, the present invention is applied to continuous casting apparatuses with a curved axis and allows to increase the quality of the products which are cast during the continuous casting, such as, merely by way of example, blooms, billets, slabs.

BACKGROUND OF THE INVENTION

To obtain a high quality cast product, it is known to subject it, during the casting steps, to a mechanical compression treatment intended to seal the liquid core and to eliminate the creation of internal defects such as segregations and solidification porosity.

In fact, during casting, the product passes from a liquid state, to a partly solid state, and then to a completely solid state and during these steps the skin of the product, which contains a liquid metal core inside it, gradually thickens until it solidifies completely at the so-called "kissing point".

The skin of the metal product is formed by heat exchange which takes place from the interaction of the product with the cooling devices. The cooling devices comprise, in the initial part, a crystallizer and, subsequently, guide rolls separated by nebulization spray devices which spray a cooling liquid onto the product.

It is also known that casting apparatuses with a curved axis have a first vertical line segment, in which the product is contained by a skin with a minimum thickness, a second curved line segment that defines a deviation of the verticality of the first vertical line segment and a third horizontal line segment.

In the second curved line segment, the skin of the metal product is rather thick and is sensitive to bending.

This sensitivity is even more pronounced in the final segment of the curve, where it is necessary to perform the actual straightening of the product in order to make it linear and suitable to transit in the machines downstream, disposed horizontally.

In the terminal segment of the second curved line segment, that is, in a condition where the metal product is substantially horizontal or pre-horizontal, as described above, the metal product is subjected, by means of opposite rolls, to the action of compression, also known as soft reduction treatment, to force the closure of the liquid cone and obtain the qualitative advantages inside the metal product, such as for example the internal segregations and porosity.

The compression straightening and extraction units that perform these actions, that is, the compression and extraction/straightening of the metal product, are precisely aligned to the theoretical casting axis of the product, that is, the imaginary axis along which the center of the cast product passes.

For this purpose, it is known to suitably design the casting apparatus so that, between each compression, straightening/extraction unit, optimal connection radii are defined which allow the metal product to pass from a vertical axis segment to a horizontal axis segment.

In particular, these connection radii are optimized to limit the surface stresses to which the skin of the metal product is subjected.

These stresses can generate cracks and rather pronounced qualitative surface defects since, at this stage, the skin of the product is gradually getting thicker and thicker.

One disadvantage of known compression straightening/extraction units used for the dual function of straightening the product and soft reduction is that they can apply excessively high forces on the metal product. In fact, in the same zone of the metal product, compression forces and straightening forces are exerted simultaneously, for example by pairs of opposite rolls.

Moreover, each compression straightening/extraction unit is distanced from the next one by a pitch which is often excessive. This entails that the force applied by each straightening unit is suffered by the product as a shearing force, since the straightening, due to the distance, is not gradual but punctual, affecting individually limited zones of the product that are distant from each other.

This causes a high risk of breaking the skin of the product, which in this zone has a rather significant thickness and is subject to a greater risk of developing cracks that would compromise the quality of the whole product.

A casting apparatus is also known from document JP-A-2013-43217, which is provided with a mold, and a plurality of containing rolls located downstream of the mold and defining a curvature of the casting line. The casting apparatus also comprises a plurality of compression/extraction units located in a substantially horizontal segment of the casting line and provided to exert a drawing action on the metal product. The compression/extraction units are defined by rolls opposite to each other and between which the metal product is made to pass. On the extrados side of the casting line and between pairs of rolls of the compression units, rolls are interposed which have the sole function of supporting and containing the metal product in transit.

This solution, however, does not allow optimum control and guidance of the metal product during its passage through the curved segment of the casting line. In this known solution too, in fact, the compression/extraction units create the problems described above. In fact, the compression/extraction units exert both a compression action on the liquid core and also a straightening action on the metal product to straighten it in its zone with the horizontal segment.

Document WO-A-2009/144107 describes a rolling stand for a continuous casting system provided with a pair of opposite rolls, defining between them a passage gap for the metal product. The roll located at the top is connected to a positioning member provided to move the upper roll with respect to the lower roll and to adjust the size of the passage gap. The positioning member, however, is not able to adjust the curvature of the casting line but only allows to adjust the compression exerted on the metal product.

One purpose of the present invention is to provide a continuous casting apparatus which allows to increase the quality of the metal products cast.

Another purpose of the present invention is to provide a continuous casting apparatus which allows to increase productivity.

Another purpose of the present invention is to provide a continuous casting apparatus which allows to process a wide range of metal materials, which in any case is able to achieve the quality standards required.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a continuous casting apparatus, according to the present invention, comprises a plurality of compression units, each of which is defined by a lower roll and an upper roll configured to exert a compression action, that is, a soft reduction, on a cast metal product.

Moreover, each lower roll defines with the respective upper roll a passage gap for the cast product, and the passage gaps of the compression units are disposed aligned along a casting axis with an at least partly curved development.

Hereafter in the description, by the term upper rolls we identify the rolls located on the intrados side of the casting axis, while the term lower rolls identifies the rolls located on the extrados side of the casting axis.

In accordance with one aspect of the present invention, the casting apparatus comprises a plurality of straightening rolls, disposed on the extrados side of the casting axis, and each of said straightening rolls is interposed between a pair of lower rolls. The casting axis is defined by a plurality of curved segments having different radii of curvature. Each curved segment is comprised between two successive straightening rolls and each of the straightening rolls is configured to straighten the cast metal product and to define a variation in the radius of curvature of the casting axis.

The particular configuration of the present invention allows to divide the stresses that are imparted on the metal product, during continuous casting.

In particular, the stress of compression or soft reduction, is entrusted to the action of compression exerted by the lower rolls and by the upper rolls, while the straightening stress of the metal product to take it from the curved condition to the substantially horizontal condition is entrusted to the action of the straightening rolls.

The division of the stress actions acting on the metal product allows to reduce the punctual stresses acting on the specific metal product since the compression stress is exerted on one portion of the metal product which is different from that in which the straightening stress is exerted.

This allows to obtain cast metal products of better surface quality, since, by reducing the punctual and overall entity of the mechanical stresses, the risk of creating surface cracks is also reduced.

In accordance with a possible solution, moving along a casting direction, corresponding with the direction of feed of the metal product, the curved segments have radii of curvature increasing along the casting axis. This allows to optimize the casting process of the metal product, without subjecting it to high curvature stresses in the terminal segment of the casting line where the metal product is substantially solidified. Indeed, the highest radii of curvature in the terminal segment of the curved segment limit the creation of surface cracks of the product and guarantees that high quality standards of the metal product are obtained.

Embodiments of the present invention also concern a method of continuous casting that provides to:

- make available a plurality of compression units, each defined by a lower roll and an upper roll between which there is a passage gap for a metal product to be cast,
- dispose the compression units so that the passage gaps are aligned along a casting axis with an at least partly curved development,
- exert during casting a compression action on a metal product by means of the compression units.

In accordance with one aspect of the method, according to the present invention, during casting it also provides to straighten the cast metal product to define a variation in the radius of curvature of the casting axis.

The straightening is performed by a plurality of straightening rolls disposed on the extrados side of the casting axis and each interposed between at least two of the lower rolls. The straightening rolls define, along the casting axis, respective curved segments having different radii of curvature from each other, each curved segment being comprised between two successive straightening rolls.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
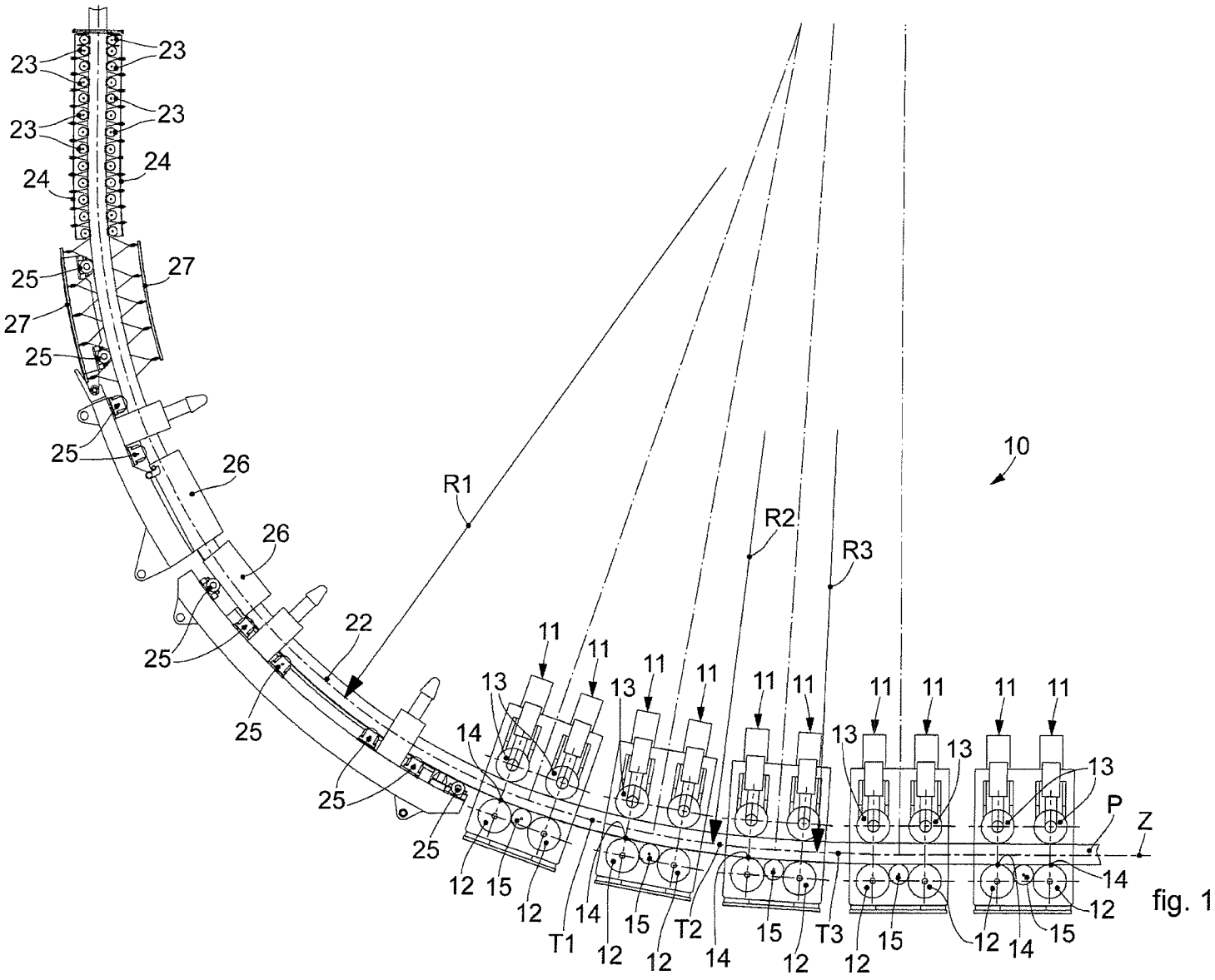
FIG. 1 is a schematic illustration of an apparatus for the continuous casting of metal products in accordance with the present invention.

With reference to FIG. 1, a continuous casting apparatus is indicated as a whole by the reference number 10 and is suitable to cast a metal product P.

In particular, the apparatus 10 according to the present invention comprises a plurality of compression units 11 each configured to exert a compression action on the metal product P, also known as soft reduction action.

Each compression unit 11 comprises a lower roll 12 and an upper roll 13 defining together with the lower roll 12 a passage gap 14 for the metal product P.

According to one aspect of the present invention, the passage gaps 14 of the compression units 11 are disposed aligned along a common casting axis Z. The casting axis Z has an at least partly curved development.

The casting axis Z substantially corresponds with the neutral axis of the metal product P in transit, that is, with the central axis of the metal product P itself.

In accordance with a possible solution, moving along a casting direction D, corresponding with the direction of feed of the metal product P, the casting axis Z has segments of curvature, with increasing radii of curvature. In other words, moving along the casting direction D, each segment of curvature has a radius of curvature greater than that of the segment of curvature that precedes it.

According to a possible solution (FIG. 1), the casting axis Z can be defined by a plurality of curved segments disposed in succession with respect to each other and each of which having a radius of curvature different from the previous or following one, as described below.

According to a variant embodiment, the casting axis Z can have a variable radius of curvature which varies with continuity along at least part of its longitudinal extension.

In accordance with some embodiments of the present invention, the compression units 11 can be disposed in correspondence with a terminal portion of the casting axis Z.

In accordance with possible solutions of the present invention, the casting axis Z, in correspondence with the first of the compression units 11, has an inclination a with respect to the horizontal comprised between 45° and 10°, preferably between 40° and 15°.

The casting axis Z in correspondence with the last of the compression units 11 is disposed substantially horizontally to allow the supply of the metal product P toward the machines located downstream.

The first and the last of the compression units 11 are evaluated along the casting direction D.

According to one aspect of the present invention, on the extrados side of the casting axis Z, that is, on the convex side of the casting axis Z, and between at least two of the lower rolls 12 of the respective compression units 11, a straightening roll 15 is interposed to straighten the metal product P.

According to one aspect of the present invention, the straightening rolls 15 also cause a variation in the radius of curvature of the casting axis Z, resulting in the consequent straightening action on the metal product P.

According to a possible solution, in a position directly opposite each straightening roll 15, and with respect to the casting axis Z, no roll is present.

The straightening roll 15, in fact, also performs a function of further support of the metal product P which is transiting between the compression units 11 located upstream and downstream with respect to the straightening roll 15 itself. The straightening roll 15 also provides a discharge point for the straightening and compression forces which are therefore perceived by the metal product P more evenly along its external surface.

In accordance with possible solutions shown in the attached drawings, the apparatus 10 comprises a plurality of straightening rolls 15 each of which is interposed between a pair of the lower rolls 12 of the respective compression units 11.

According to a possible aspect of the present invention, the casting axis Z can be defined by a plurality of curved segments having different radii of curvature.

Figure 2:
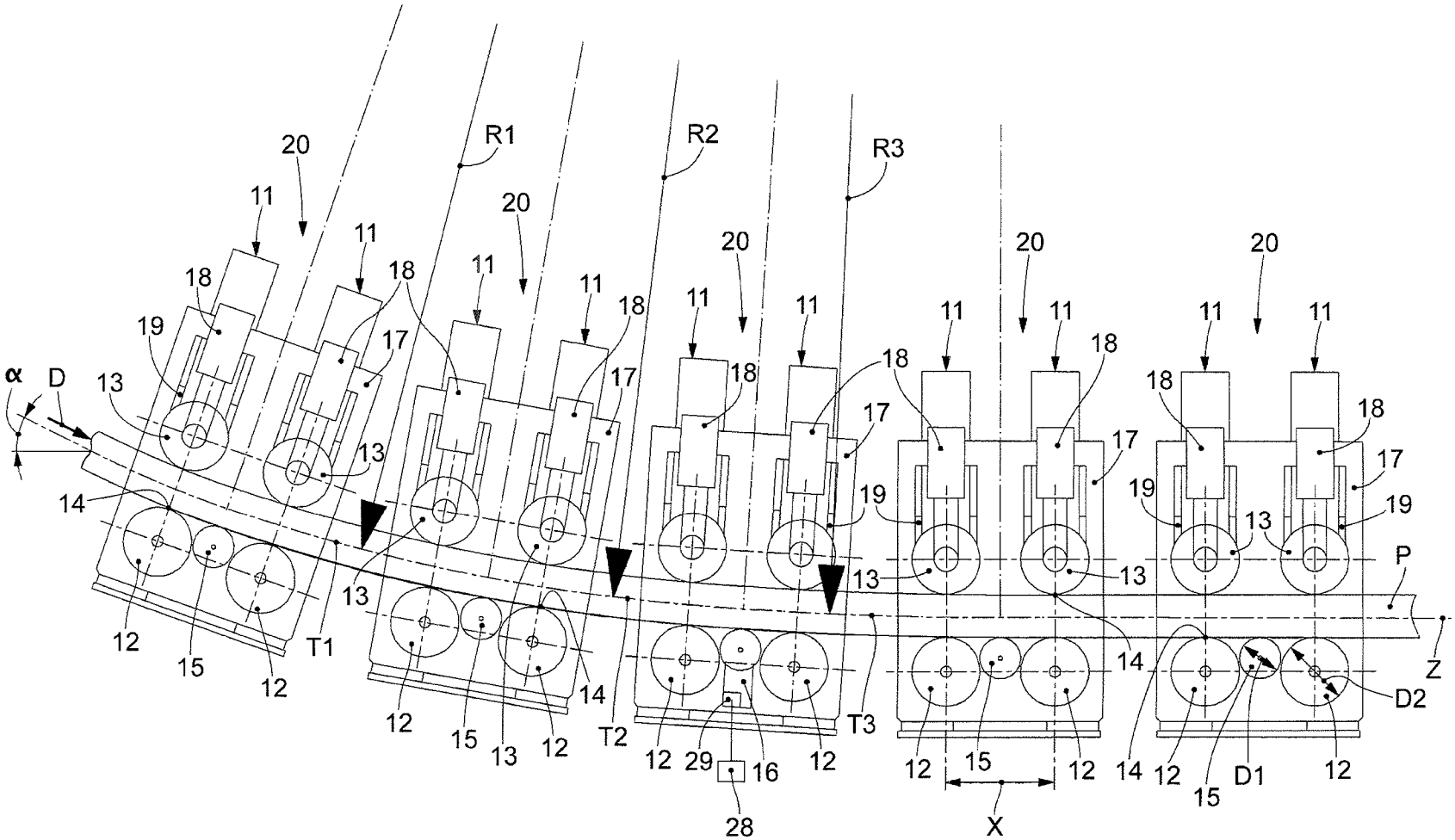
FIG. 2 is an enlarged view of part of FIG. 1.

In the case shown in FIG. 2, the casting axis Z is defined at least by a first curved segment T1, a second curved segment T2, and a third curved segment T3 disposed in succession with respect to each other along the casting direction D.

The curved casting segments each have their own radius of curvature, respectively a first radius of curvature R1, a second radius of curvature R2 and a third radius of curvature R3. It is not excluded that in possible variant embodiments the number of curved segments is different, as is the number of radii.

The radii of curvature R1, R2 and R3 are different from each other, and in particular the radius of curvature R2 is greater than the radius of curvature R1, and in turn the radius of curvature R3 is greater than the radius of curvature R2.

According to a possible solution, each curved segment T1, T2 and T3 can be comprised between two successive straightening rolls 15, located along the casting direction D.

According to possible solutions, at least one of the straightening rolls 15 is provided with a positioning member 16, provided to selectively position the straightening roll 15 with respect to the casting axis Z.

Although in FIG. 2 a single positioning member 16 is shown, associated with the respective straightening roll 15, it is not excluded that the other straightening rolls 15 or at least some of them are provided with a respective positioning member 16.

The positioning member 16 can be disposed so as to move the respective straightening roll 15 in a transverse direction, preferably orthogonal, to the casting axis Z. This allows to control and possibly modify the entity of stress imparted to the metal product P.

In accordance with possible solutions, the positioning member 16 can be connected to a control member 28 provided to perform, through the positioning member 16, the positioning of the respective straightening roll 15. The positioning of the straightening roll 15 can be performed by means of a position control, or a force control.

In accordance with possible solutions, at least one sensor 29 can be associated with the straightening roll 15, for example with the positioning member 16 or its control member, in order to detect the stresses acting on the straightening roll 15 itself. The sensor 29 is in turn connected to the control member 28 which is configured to command the activation of the positioning member 16.

On the basis of these data, it is possible to estimate the stresses acting on the metal product P and to evaluate possible problems of the creation of surface cracks.

According to a possible solution, the straightening rolls 15 can be idle, that is, free to rotate around their own axes of rotation.

In accordance with a possible solution, the straightening rolls 15 can have a first diameter D1 which is smaller than a second diameter D2 of the lower roll 12, and/or of the upper roll 13 of the compression units 11. This condition allows to position the lower rolls 12, located directly upstream and downstream of the straightening roll 15 considered, in a very close position with each other. This provides a high guide and containing action for the metal product P.

According to a possible solution, the first diameter D1 can be comprised between 0.4 and 0.8 times the second diameter D2, preferably between 0.5 and 0.7.

According to a possible solution, two of the lower rolls 12, between which a respective straightening roll 15 is interposed, have an interaxis X with a size smaller than or equal to twice the diameter D2 of the lower roll 12.

This solution allows to increase the support points of the metal product P during straightening and soft reduction, and thus considerably increases the capacity of the compression units 11 to discharge the forces, distributing them more evenly along the casting axis Z and avoiding concentrating them on sporadic and distanced points of the metal product P.

According to a possible solution, the interaxis X has a size comprised between 1.2 and 1.7 times the diameter D2 of the lower roll 12. This allows to dispose the compression units 11 in a very close position with each other, and in this way to increase the effectiveness of the compression of the liquid core.

According to another solution, the straightening roll 15 is positioned substantially in the center line of the interaxis X between the two lower rolls 12. This allows to make the stresses of the metal product P uniform upstream and downstream of the zone in which it interacts with the straightening roll 15.

According to a possible solution, the lower rolls 12 and the respective upper rolls 13 can have substantially the same diameter D2. This allows to induce substantially the same stresses on the intrados side and the extrados side, since the respective contact surfaces with the metal product P are substantially the same on one side and on the other.

In accordance with a possible solution, it can be provided that the lower rolls 12 are installed in a substantially fixed position, for example with respect to a support structure 17. In particular, the lower rolls 12 are selectively rotatable around respective axes of rotation located horizontal and orthogonal to the casting axis Z.

According to a possible solution, the upper rolls 13 can be movable toward/away from the respective lower rolls 12. This allows to control and/or determine the compression action of the metal product P in a desired manner.

In accordance with a possible solution, the upper rolls 13 comprise movement members 18 provided to move the upper rolls 13 toward/away from the lower rolls 12.

The movement members 18 allow to modify the sizes of the passage gaps 14 and to manage the entity of compression that the lower rolls 12 and upper rolls 13 impart on the metal product P in transit. The movement members 18 can possibly be regulated by position sensors.

According to possible solutions, at least the upper rolls 13 can be installed on respective support elements 19, also referred to as chocks, which in turn are connected to the respective movement members 18 of the upper rolls 13.

According to a possible solution, the support elements 19 are installed mobile along sliding guides provided on the support structure 17.

In accordance with a possible solution, it can be provided that two of the compression units 11, between which a straightening roll 15 is interposed, are installed on a common support structure 17. This allows to obtain respective guide and containing modules 20 selectively replaceable, for example, for change-in-format operations or for the required maintenance operations, and at the same time allows to minimize the space between two guide and containing modules 20, that is, adjacent straightening, extraction and compression units, thus allowing optimal application of the forces on the product. Moreover, the guide and containing modules 20 can be installed for example on respective bases, having respective support surfaces suitably inclined to dispose the compression units 11 and the straightening rolls 15 aligned along the casting axis Z.

According to possible solutions, upstream of the compression units 11, guide and containing devices 21 can be provided, suitable to guide and contain the movement of the metal product P being cast.

According to a possible aspect of the present invention, the guide and containing devices 21 define a guide segment 22 of the casting axis Z, located upstream of the first segment T1 and having a substantially constant radius of curvature. The radius of curvature of the guide segment 22 can be substantially equal to the first radius of curvature R1.

In accordance with a possible solution, the guide and containing devices 21 can comprise a plurality of guide rolls 23 opposite each other with respect to the casting axis Z and having the function of guiding and containing the metal product P for example exiting from the mold, not shown.

Cooling devices 24 can be associated with the guide rolls 23, for example of the nebulization spray type, provided to cool the metal product P and generate a thickening of the skin.

The guide and containing devices 21 can also comprise support rolls 25 positioned on the extrados side of the guide segment 22 to support the metal product P being cast.

According to possible solutions, heat insulation bodies 26 can be installed along at least the guide segment 22, suitable to control and limit the heat dispersions to which the metal product P is subjected. The heat insulation bodies 26 can also have the function of limiting oxidation phenomena of the metal product P.

Other cooling devices 27 can be associated with the guide segment 23, suitable to cool the metal product P in transit.

The cooling devices 27 can be configured to emit jets of nebulized liquid onto the metal product P.

It is clear that modifications and/or additions of parts can be made to the continuous casting apparatus and corresponding method as described heretofore, without departing from the field and scope of the present invention.

It is also clear that, although the present invention has been described with reference to some specific examples, a person of skill in the art shall certainly be able to achieve many other equivalent forms of casting apparatus and corresponding casting method, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Continuous casting apparatus comprising a plurality of compression units (11), each of which is defined by a lower roll (12) and an upper roll (13) configured to exert a compression action on a cast metal product (P), each lower roll (12)

defining with the respective upper roll (13) a passage gap (14) for the metal product (P), and the passage gaps (14) of said compression units (11) being disposed aligned along a casting axis (Z) with an at least partly curved development, wherein it comprises a plurality of straightening rolls (15), disposed only on the extrados side of said casting axis (Z), and each of which is interposed between a pair of said lower rolls (12) positioned on said extrados side, said casting axis (Z) being defined by a plurality of curved segments (T1, T2, T3) having different radii of curvature (R1, R2, R3), each curved segment (T1, T2, T3) being comprised between two successive straightening rolls (15), each of said straightening rolls (15) being configured to straighten the cast metal product (P) and define a variation in the radius of curvature of said casting axis (Z).

2. Apparatus as in claim 1, wherein, moving along a casting direction (D), corresponding to a direction of feed of said metal product (P), said curved segments (T1, T2, T3) have increasing radii of curvature along said casting axis (Z).

3. Apparatus as in claim 1, wherein at least one of said plurality of straightening rolls (15) is provided with a positioning member (16) provided to selectively position said at least one straightening roll (15) with respect to said casting axis (Z).

4. Apparatus as in claim 3, wherein at least one sensor (29) is associated with said at least one straightening roll (15) to detect stresses acting on said at least one straightening roll (15), and in that said at least one sensor (29) is connected to a control member (28) configured to command activation of said positioning member (16).

5. Apparatus as in claim 1, wherein said straightening rolls (15) have a first diameter (D1) which is smaller than a second diameter (D2) of said lower rolls (12), and/or of said upper rolls (13).

6. Apparatus as in claim 1, wherein the lower rolls (12), between which said straightening roll (15) is interposed, have an interaxis (X) with a size smaller than or equal to twice the second diameter (D2) of said lower roll (12).

7. Apparatus as in claim 6, wherein said straightening roll (15) is positioned in the center line of said interaxis (X).

8. Apparatus as in claim 1, wherein two of said compression units (11), between which said straightening roll (15) is interposed, are installed on a common support structure (17).

9. Apparatus as in claim 1, wherein said lower rolls (12) are installed in a fixed position with respect to a support structure (17) and are selectively rotatable around respective axes of rotation located horizontal and orthogonal to the casting axis (Z), and in that said upper rolls (13) comprise movement members (18) to move the upper rolls (13) toward or away from the lower rolls (12).

10. Continuous casting method that provides to make available a plurality of compression units (11), each defined by a lower roll (12) and an upper roll (13) between which there is a passage gap (14) for a metal product (P) to be cast, to dispose said compression units (11) so that the passage gaps (14) are aligned along a casting axis (Z) with an at least partly curved development, and to exert during casting compression actions on the metal product (P) by means of said compression units (11), wherein during casting it also provides to straighten said cast metal product (P) to define a variation in the radius of curvature of said casting axis (Z), said straightening being performed by a plurality of straightening rolls (15) disposed only on the extrados side of said casting axis (Z) and each of them interposed between at least two of said lower rolls (12) positioned on said extrados side, and in that said straightening rolls (15) define, along said casting axis (Z), respective curved segments (T1, T2, T3) having different radii of curvature (R1, R2, R3), each curved segment (T1, T2, T3) being comprised between two successive straightening rolls (15).

* * * * *